US008339761B2

(12) United States Patent
Yamada et al.

(10) Patent No.: US 8,339,761 B2
(45) Date of Patent: Dec. 25, 2012

(54) RELAY FAILURE DETECTING DEVICE

(75) Inventors: Akira Yamada, Tokyo (JP); Yuuichi Kumazawa, Tokyo (JP); Katsumi Morikawa, Tokyo (JP)

(73) Assignee: Azbil Corporation, Tokyo (JP)

( * ) Notice: Subject to any disclaimer, the term of this patent is extended or adjusted under 35 U.S.C. 154(b) by 449 days.

(21) Appl. No.: 12/785,948

(22) Filed: May 24, 2010

(65) Prior Publication Data

US 2010/0302696 A1 Dec. 2, 2010

(30) Foreign Application Priority Data

May 28, 2009 (JP) ..... 2009-128920

(51) Int. Cl.
*H01H 47/00* (2006.01)

(52) U.S. Cl. ..... 361/160

(58) Field of Classification Search ..... 361/160
See application file for complete search history.

(56) References Cited

U.S. PATENT DOCUMENTS

| | | | | |
|---|---|---|---|---|
| 4,025,836 | A * | 5/1977 | Naito et al. | 318/490 |
| 4,977,478 | A * | 12/1990 | Powell | 361/160 |
| 5,559,376 | A * | 9/1996 | Tachikawa | 307/86 |
| 7,208,955 | B2 * | 4/2007 | Zansky et al. | 324/418 |

FOREIGN PATENT DOCUMENTS

| | | |
|---|---|---|
| CN | 2620283 | 6/2004 |
| CN | 201048366 | 4/2008 |
| CN | 101436822 | 5/2009 |
| JP | 03-273811 A | 12/1991 |

OTHER PUBLICATIONS

Office Action dated Aug. 31, 2012 from the State Intellectual Property Office (SIPO) in Beijing, China, which issued during the prosecution of Patent Application CN 2010 10190161.3 which corresponds to the present application.

* cited by examiner

*Primary Examiner* — Stephen W Jackson
(74) *Attorney, Agent, or Firm* — Troutman Sanders LLP

(57) ABSTRACT

A relay failure detecting device able to detect reliably a fault in a relay circuit that provides alternating current power to a load through a relay that is a double-pole switch. Individual common terminals of first and second relays are connected individually to a pair of outputs terminals of an alternating current power supply, individual normally-open terminals of the first and second relays are connected to a pair of power supply input terminals, and a dummy load that is driven by the alternating current power supply through a diode between the individual normally-closed terminals of the first and second relays is provided. A fault in the first and second relays is evaluated from the state of operation of the dummy load when the first and second relays are not driven.

4 Claims, 2 Drawing Sheets

RELAY FAILURE DETECTING DEVICE

CROSS REFERENCE TO RELATED APPLICATIONS

The present application claims priority under 35 U.S.C. §119 to Japanese Patent Application No. 2009-128920, filed May 28, 2009, which is incorporated herein by reference.

FIELD OF TECHNOLOGY

The present invention relates to a relay failure detecting device for detecting a fault in a relay circuit that provides alternating current electric power through a relay that serves as a double-pole switch to a load.

BACKGROUND OF THE INVENTION

When turning ON/OFF a load that is driven by AC power, a ground fault strategy is performed entirely using a double-pole switch relay (switch). However, when there is a failure, such as the fusing of relay contact points it becomes impossible to control the supply of power to the load safely. For this reason, it is important to, for example, monitor for failures in the relay contact points, and the like, in order to guarantee the safety of the relay output.

Note that, as a method for detecting a relay failure, it has been proposed that a relay failure be detected through a logical process on a signal indicating the state of operation of a supplemental relay contact point and the input signal thereto, using a supplemental relay contact point (a second relay contact point) that is turned ON and OFF in addition to a primary relay contact point (a first relay contact point) that is turned ON and OFF by an input signal, as disclosed in, for example, Japanese Unexamined Patent Application Publication H3-273811 ("JP '811").

However, in the method shown in JP '811, there is the problem of not being able to guarantee reliably the accuracy of the relay output because, for example, fault detection itself would become impossible if there were a failure in the fault detecting circuit that includes the supplemental relay contact point.

The present invention was created in such a situation, and the object thereof is to provide a relay failure detecting device wherein the stability of the relay output can be secured through reliably detecting faults in a relay circuit that supplies alternating current electric power through a double-pole switch relay to a load.

SUMMARY OF THE INVENTION

The present invention, by which to achieve the object set forth above, focuses on how it is extremely desirable that a relay that turns ON and OFF the supply of power is provided with a normally-on terminal and a normally-off terminal that can be connected selectively to a common terminal, extremely desirable that this type of relay is used in order to turn ON and OFF the alternating current through a double-pole switch to the load, and extremely desirable that that two relays that form the double-switch pole to have faults simultaneously.

The relay failure detecting device according to the present invention comprises:

a relay output circuit, provided with a plurality of relays which, when not driven, connect between a common terminal and a normally-closed terminal, that when driven connect between the common terminal and a normally-open terminal, where each of the common terminals of these relays are connected individually to a plurality of output terminals in the AC power supply; and evaluating means, provided with a dummy load that is driven by the AC power supply, through a diode between the plurality of relays and the individual normally-closed Terminals to determine whether or not there is a fault in the plurality of relays from the state of operation of the dummy load when in the non-driven state for the plurality of relays.

Note that when the load is driven by single-phase alternating current, the plurality of relays will be a first and a second relay, and when the load is driven by three-phase alternating current, the plurality of relays will be a first, second, and third relay. Moreover, in the case of three-phase alternating current, the dummy load will be provided in a delta connection or a star connection for, for example, the U-V pair, the V-W pair, and the W-U pair.

Another relay failure detecting device according to the present invention is, in addition to the structure described above, provided with also second evaluating means, wherein a second dummy load that is connected on one end to one of the input terminals of the aforementioned load, and connected, on the other end, through respective diodes to the individual common terminals of the plurality of relays, for evaluating whether or not there is a fault in the plurality of relays from the operating state of the second virtual load at the time of not driving of the plurality of relays.

Note that the aforementioned dummy load and the second dummy load that are, for example, light-emitting elements that are driven by an alternating current power source and photocouplers that are light-detecting elements that are optically coupled to the light-emitting elements, and the evaluating means have a controlling device for controlling the operation of the driving circuits for the plurality of loads, where the photocoupler achieves the function of detecting the output of an optical element in a photocoupler.

Because a relay failure detecting device as structured above makes it possible to use the normally-open contact points of the plurality of relays to confirm the return of the contact point of the relays when in a non-driven state, enabling a reliable detection of a fused failure of the common terminal and the normally-open terminal. Furthermore, it is possible to perform self-diagnostics also of failures in the failure detecting system itself from the state of operation of the dummy load when the relay is in the non-driven state.

Furthermore, performing evaluations of the operating state of the second dummy load makes it possible to detect reliably also all fuse failures between common terminals, normally-open contact points, and normally-closed contact points in the relays. The result is the ability to stop the driving itself of the relay when a failure has been detected, making it possible to guarantee the safety of the relay output.

DETAILED DESCRIPTION OF THE INVENTION

The figures will be referenced below to explain an example of a relay circuit for driving a load using a single-phase alternating current in a relay failure detecting device according to a form of embodiment according to the present invention.

Figure 1:
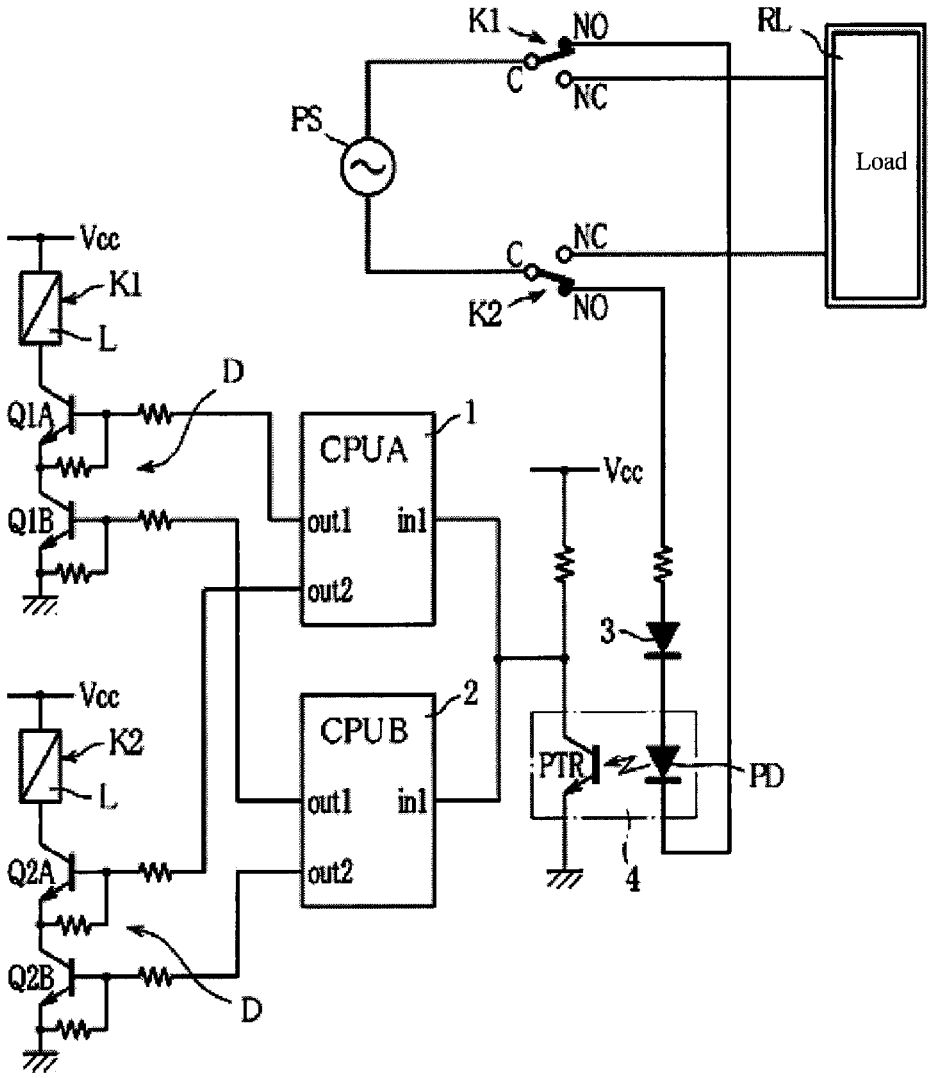
FIG. 1 is a schematic structural diagram of a relay failure detecting device according to a form of embodiment according to the present invention.

FIG. 1 is a critical component schematic structural diagram of a relay failure detecting device according to a first form of embodiment according to the present invention, where PS is a single-phase alternating current power supply, and RL is a load, such as a motor, that is driven through the reception of the AC power from the single-phase alternating current power supply PS. Furthermore, the ON/OFF control of the AC power that is supplied to the load RL from the single-phase alternating current power supply PS is performed remotely through the use of first and second relays (switches) K1 and K2, which form a double-pole switch for the load RL.

Note that the first and second relays (switches) K1 and K2 are provided with switching functions for switching the contact of the common terminal C through mechanically dislocating the movable contact piece that is connected to the common terminal C through an electric current in an electromagnetic coil L that is the driving part to connect the movable contact piece to the normally-closed terminal (the normally-closed side) when not being driven, and connecting the movable contact piece to be normally-open terminal (the normally-open side) when driven. Note that here the first and second relays K1 and K2 are explained as using mutually independent relays, but, of course, so-called two-circuit-type relays, wherein two movable contact pieces are driven simultaneously using a single electromagnetic coil L can also be used instead.

Furthermore, in the present form of embodiment, in the first and second relays K1 and K2, not only are the common terminals C and C connected separately to a pair of power supply output terminals in the AC power supply PS, but also the individual normally-open terminals NO and NO of the first and second relays K1 and K2 are provided connected to a pair of power supply input terminals in the load RL. Consequently, these first and second relays K1 and K2 supply AC power from the alternating current power supply PS to the load RL through forming closed circuits through the load RL through connecting from each of the common terminals C through the normally-open terminals NO to the alternating current power supply PS and the load RL simultaneously when each are driven.

Note that the individual electromagnetic coils L and L of these first and second relays K1 and K2 have the currents therein controlled individually by two driving circuits D and D, disposed in parallel. Additionally, the individual driving circuits D and D comprise, for example, transistors Q1A and Q1B, and transistors Q2A and Q2B, which have two-stage structures that are each connected in series to the respective electromagnetic coils L and L. Each of these individual transistors Q1A, Q1B, Q2A, and Q2B have the conduction thereof controlled through the receipt of the respective switch-driving circuits that are outputted, respectively, from two control devices (for example, CPUs) 1 and 2 that are provided in parallel, and thus by merely outputting the switch driving signals simultaneously from the aforementioned control devices (for example, CPUs) 1 and 2, the first and second relays K1 and K2, respectively, are put into the conductive states.

Furthermore, providing these two control devices (for example, CPUs) 1 and 2 in parallel achieves multiplexing of the control system, thereby increasing the level of the operational safety; however, fundamentally, it would be enough to structure only a single control system. Additionally, while in the explanation here ON/OFF control of the AC power to the load RL is performed using the first and second relays K1 and K2, of course, the double-pole switching control of the power supply to the load RL may be performed using a single relay that is provided with two circuits worth of switch contact points.

Given this, in the relay output circuit that is structured as described above, fundamentally the relay failure detecting device according to the present invention is provided with a dummy load 4 that is driven by the alternating current power supply PS through a diode 3 between the individual normally-closed terminals NC and NC of the first and second relays K1 and K2, structured so as to evaluate whether or not there is a fault in the respective first and second relays K1 and K2, in the individual control devices 1 and 2 from the operating state of the dummy load 4 when the first and second relays K1 and K2 are not driven. Specifically, the dummy load 4 is made from a photocoupler that is made from a light-emitting element PD that is connected in series with a diode 3, and a light-detecting element PTR that is optically coupled to the light-emitting element PD. Additionally, in the control devices 1 and 2, evaluating whether or not the dummy load 4 is driven when the first and second relays K1 and K2 are not driven evaluates whether or not there is a fault in the first and second relays K1 and K2, preventing the individual relays K1 and K2 from being driven when a failure is detected.

Specifically, whether or not there is a fault in the first and second relays K1 and K2, as described above, is evaluated as follows.

That is, when there is no failure in the first and second relays K1 and K2 (when they are functioning properly), the common terminals C are connected to the normally-open terminal NO sides through the driving of the relays K1 and K2, and thus the AC power is provided to the load RL through the normally-open terminals NO. At this time, the AC power is not outputted to the normally-closed terminal NC side. Then, when the driving of the relays K1 and K2 is stopped (that is, when in the non-driven state), the common terminals C are connected to the normally-closed NC sides, so the output of the AC power to the normally-open NO side stops, and instead the AC power is outputted to the normally-open terminal NC sides. When this is done, the AC power is applied to the dummy load 4 after half-wave rectification through the diode 3, so that the light-emitting element PD of the dummy load 4 is driven to emit light for each half cycle, synchronized with the alternating current power supply frequency. Given this, the light-detecting element PTR that is optically coupled to the light-emitting element PD becomes conductive, and generates a pulse signal, each time the emission of light by the light-emitting element PD is detected.

In contrast, when the first and second relays K1 and K2 are driven, if the movable contact piece of one of the relays K1 (or K2) is fused to the normally-open terminal NO, then even if the driving of the relays K1 and K2 has been stopped (a non-driven state), the movable contact piece that that is fused to the normally-open terminal NO will not switch to the normally-closed terminal NC side. Consequently, in this case the alternating current will not be outputted to the normally-closed contact terminal NC side, and thus there will be no supply of the AC power to the dummy load 4, and, as a result, the light-emitting element PD will not be driven to emit light, and this pulse signal will not be generated. Consequently, by confirming that the pulse signal is detected only when the driving of the relays K1 and K2 has been stopped (in a non-driven state) without detecting the pulse signals when K1 and K2 are driven makes it possible to detect a contact point failure in the relays K1 and K2. In other words, when the pulse signal cannot be detected even when the driving of the relays K1 and K2 has been stopped, this can be detected as there being a relay contact point of failure.

At the same time, constantly monitoring that the pulse signals are not outputted when the relays K1 and K2 are driven and that the pulse signals are outputted reliably when the relays K1 and K2 are not driven makes it possible to check whether or not a failure has occurred in the detecting circuit itself. Consequently, it becomes possible to evaluate easily whether or not the relay outputs are functioning properly, to stop the driving itself of the relays K1 and K2 when a fault has been detected, and to shut off the electric current circuit to the load RL using the relay K1 (or K2) on the side wherein the failure did not occur, to guarantee the safety of the relay output.

Note that in the structure set forth above, if the common terminal C, the normally-open terminal NO, and the normally-closed terminal NC were all sorted together for one of the relays K1 or K2, then even if the driving of the relays K1 and K2 were stopped, the AC power would be supplied to the dummy load 4 through the fused terminals C, NO, and NC, and so the pulse signal would be produced. Consequently, as described above, it would not be possible to evaluate the failure from merely whether or not there is a pulse signal when the relays K1 and K2 are not driven. Furthermore, in such a case, even if the relays K1 and K2 are driven, the supply of the AC power to the dummy load 4 through the relay that is functioning properly is cut off, and thus the pulse signal would be stopped in the same manner as in the case of the double-pole switches K1 and K2 functioning properly. Consequently, in the structure described above it is not possible to detect a fault (failure) wherein the common terminal C, the normally-open terminal NO, and the normally-closed terminal NC are all shorted together.

Consequently, in order to handle this type of case, the failure evaluation should be performed as follows, for example.

Figure 2:
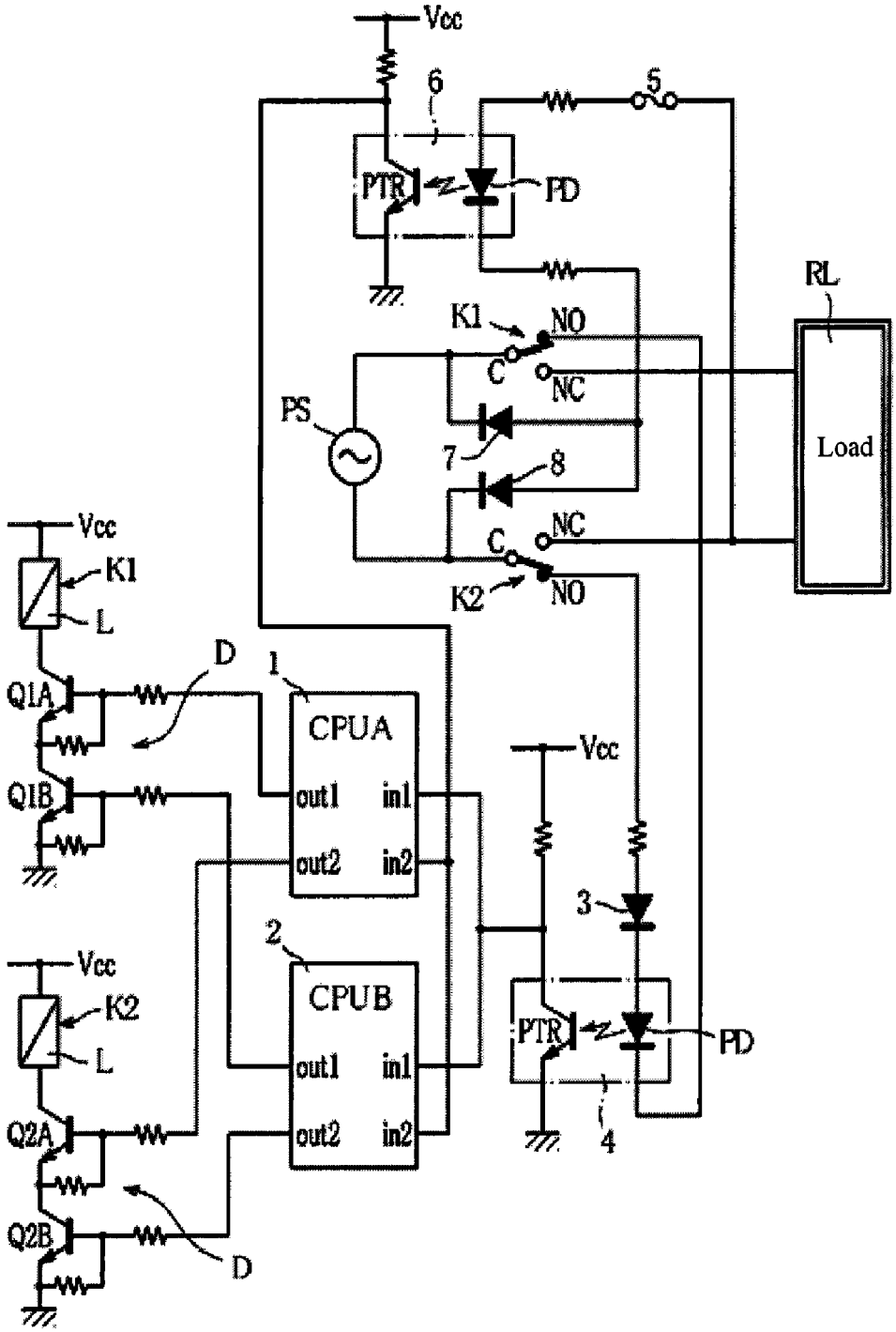
FIG. 2 is a schematic structural diagram of a relay failure detecting device according to another form of embodiment according to the present invention.

FIG. 2 illustrates that form of embodiment, and parts that are identical to those in the device illustrated in FIG. 1 are indicated through the assignment of identical codes. The device according to this form of embodiment is achieved through adding, to the form of embodiment illustrated in FIG. 1, described above, an additional connection of one end of a second dummy load 6 through a fuse 5 to one of the power supply input terminals of the load RL, and connections of the other end of the second dummy load 6 through diodes 7 and 8 to the respective common terminals for the first and second relays K1 and K2. The second dummy load 6 is also made from a photocoupler that is made from a light-emitting element PD and a light-detecting element PTR that is optically coupled to the light-emitting element PD, in the same manner as for the dummy load 4. Furthermore, a second pulse signal that is produced by the second dummy load 6 is applied in parallel with the pulse signal described above to the respective control devices 1 and 2, so that in the individual control devices 1 and 2, the non-failed state of the relays K1 and K2, described above, is evaluated based on whether or not there are these two types of pulse signals.

The operation of the dummy load 4 in a device that is structured in this way is the same as in the form of embodiment described above. However, in the case of the present form of embodiment, if, for example, the second relay K2 were to be fused, then even when the driving of the first and second relays K1 and K2 is stopped (that is, in the non-driven state), a pulse signal would be produced in the second dummy load 6 because of the alternating current that flows sequentially from the second relay K2 through the fuse 5, the second dummy load 6, and the diode 7. Furthermore, if the first relay K1 were to be fused, then even if the driving of the first and second relays K1 and K2 were to be stopped (that is, a non-driven state), a pulse signal would be produced in the second dummy load 6 because of the AC current that would flow from the first relay K1 sequentially through the load file, the fuse 5, the second dummy load 6, and the diode 8.

Additionally, when the driving of the first and second relays K1 and K2 has been stopped (a non-driven state), it is only when the relays K1 and K2 properly switch to the normally-closed terminal NC side that the route for the electric current through the second dummy load 6 is cut off. Consequently, it is possible to detect a failure in the first and second relays K1 and K2 through evaluating whether or not a pulse signal is detected through the second dummy load 6 when the first and second relays K1 and K2 are not driven.

Note that in the case of the present form of embodiment, when the first and second relays K1 and K2 are driven, fundamentally, the alternating current flows sequentially through the second relay K2, the fuse 5, the second dummy load 6, and the diode 8. Actually, a current route should not be formed through the dummy load 4 that is connected to the normally-closed terminal NC side of the relays K1 and K2. Consequently, an evaluation of the state of failure may be performed through checking whether or not the pulse signal is produced in the dummy load 4 when the relays K1 and K2 are driven. That is, when the first or second relays K1 and K2 has failed, the pulse signal will be produced and only the second dummy load 6, and when not driven, then the pulse signal will be produced in only the dummy load 4, and thus a failure evaluation may be performed for the first and second relays K1 and K2 through an overall evaluation of these relationships.

Note that a fuse with a rated current that is sufficiently smaller than the driving current of the load RL should be used for the fuse 5. If the rated current for the fuse 5 is established in this way, then even if the relay K1 were to become fused, the AC current that flows sequentially through the relay K1, the load RL, the fuse 5, the dummy load 6, and the diode 8 would burn out the fuse 5, so that no abnormal electric current would be supplied to the load RL. The proper pulse signal would not be produced in the second dummy load 6 if the fuse 5 were to burn out, making it possible to detect the failure and the detection system.

Additionally, the failure detecting device structured as set forth above makes it possible to detect not only failures in the relays K1 and K2 that turn ON and OFF the supply of AC power to the load RL, but additionally to detect reliably also failures in the failure detection system itself. The supply of power to the load RL can be stopped reliably through the use of that at least the relay on the side wherein the contact point has not been fused, by stopping the driving of the relays K1 and K2 that perform the double-pole switching control of the supply of power to the load RL. Consequently, this makes it possible to ensure fully the safety of the relay output. Moreover, because of the redundancy in the driving system for the relays K1 and K2 in the form of embodiment described above, there are effects such as ensuring reliably safety in the operation.

Note that the present invention is not limited to the forms of embodiment described above. For example, the driving systems for the relays K1 and K2 may be made doubly redundant. Additionally, as described above, the supply of power to the load RL using the double circuit-type relay enables double-pole switching control as well. Furthermore, while the explanation here it was for a case wherein the load is provided with a pair of power supply input terminals, there is no limitation thereto. In a case wherein the load is provided with a set of three power supply input terminals (for example, for a three-phase electric motor, or the like), three relays may be provided for turning ON and OFF the input of power into the respective power supply input terminals, and the present invention may be applied thereto in the same manner. That is, if the power supply terminals are U, V, and W, then dummy loads in the same manner as in the examples of embodiment set forth above may be connected, in delta connections or star connections, to the U-V pair, the V-W pair, and the W-U pair, and failures in each of the relay contact points may be detected through the state of operation of these dummy loads. Embodiments are possible through various other modifications in a range that does not deviate from the scope or intent of the present invention.

The invention claimed is:

1. A relay failure detecting device in a relay output circuit that is provided with a plurality of relays that, when not driven, connected between a common terminal and a normally-closed terminal, and that when driven, connected between the common terminal and a normally-open terminal, where the individual common terminals of the relays are connected individually to the plurality of outputs terminals in an alternating current power supply, and the individual normally-open terminals in the relays are connected individually to a plurality of power supply input terminals; comprising:

a dummy load that is driven by the alternating current power supply through a diode, between the individual normally-closed terminals of the plurality of relays, and that is provided with an evaluating device evaluating, from the state of operation of the dummy load, whether or not there is a failure in the plurality of relays when the plurality of relays is not driven.

2. A relay failure detecting device as set forth in claim 1, wherein:

the dummy load is a photocoupler made from a light-emitting element that is driven by the alternating current power supply, and a light-detecting element that is optically coupled to the light-emitting element; and the evaluating device has a control device for controlling the operation of a driving circuit for each relay, and achieve a function for detecting the output of the light-detecting element.

3. A relay failure detecting device as set forth in claim 1, further comprising:

a second dummy load device connected on one end to one of the power supply inputs of the load and connected on the other end through respective diodes to the individual common terminals of the plurality of relays; and second evaluator evaluating whether or not there is a failure in the plurality of relays based on the operating status of the second dummy load when the plurality of relays is not driven.

4. A relay failure detecting device as set forth in claim 3, wherein:

the second dummy load is a photocoupler made from a light-emitting element that is driven by the alternating current power supply and a light-detecting element that is optically coupled to the light-emitting element; and the second evaluating device has a control device for controlling the operation of a driving circuit for each relay, and achieve a function for detecting the output of the light-detecting element.

* * * * *